US009156297B2

(12) United States Patent
Amgwerd et al.

(10) Patent No.: US 9,156,297 B2
(45) Date of Patent: Oct. 13, 2015

(54) MARKING DEVICE FOR MARKING BALLS, USE OF SUCH A MARKING DEVICE, AND METHOD FOR PROVIDING SUCH A MARKING DEVICE

(75) Inventors: Luc Amgwerd, Evilard (CH); Annette Lehmann, St. Niklausen (CH); Markus Mast, Bern (CH); Vincent Vaucher, Eschert (CH)

(73) Assignee: Annette Lehmann, St. Niklausen (CH)

( * ) Notice: Subject to any disclaimer, the term of this patent is extended or adjusted under 35 U.S.C. 154(b) by 216 days.

(21) Appl. No.: 14/117,134

(22) PCT Filed: May 11, 2012

(86) PCT No.: PCT/EP2012/058796

§ 371 (c)(1),
(2), (4) Date: Dec. 4, 2013

(87) PCT Pub. No.: WO2012/156318

PCT Pub. Date: Nov. 22, 2012

(65) Prior Publication Data

US 2014/0090570 A1 Apr. 3, 2014

(51) Int. Cl.

| | |
|---|---|
| ***B41K 1/26*** | (2006.01) |
| ***B41K 3/00*** | (2006.01) |
| ***B41K 1/00*** | (2006.01) |
| ***B41K 1/36*** | (2006.01) |
| ***B41K 1/38*** | (2006.01) |
| ***B41K 1/40*** | (2006.01) |
| ***B41K 1/28*** | (2006.01) |
| ***B41K 1/50*** | (2006.01) |
| ***B41K 1/52*** | (2006.01) |
| ***B41K 1/32*** | (2006.01) |

(52) U.S. Cl.

CPC . *B41K 3/00* (2013.01); *B41K 1/006* (2013.01); *B41K 1/28* (2013.01); *B41K 1/32* (2013.01); *B41K 1/36* (2013.01); *B41K 1/38* (2013.01); *B41K 1/40* (2013.01); *B41K 1/50* (2013.01); *B41K 1/52* (2013.01)

(58) Field of Classification Search

CPC ..... B41K 1/02; B41K 1/006; B41K 1/28; B41K 1/32; B41K 1/36; B41K 1/38; B41K 1/40; B41K 1/42; B41K 1/44; B41K 1/50; B41K 1/52; B41K 1/54; B41K 3/00; B41K 3/20

USPC ..... 101/104, 327, 333, 334, 405

See application file for complete search history.

(56) References Cited

U.S. PATENT DOCUMENTS

| | | | | |
|---|---|---|---|---|
| 2,318,465 A | | 5/1943 | Chollar | |
| 3,444,808 A | * | 5/1969 | Schwartzman | 101/125 |
| 3,570,396 A | * | 3/1971 | Schwartzman | 101/125 |

FOREIGN PATENT DOCUMENTS

| | | | | |
|---|---|---|---|---|
| WO | 9810937 | * | 3/1998 | B41K 1/32 |
| WO | WO2009087011 | | 7/2009 | |

*Primary Examiner* — Blake A Tankersley
*Assistant Examiner* — Marissa Ferguson Samreth
(74) *Attorney, Agent, or Firm* — Notaro, Michalos & Zaccaria P.C.

(57) ABSTRACT

Marking device (10) having a housing, a stamp pad (13) and an ink reservoir (15), wherein the ink reservoir (15) has a fluid connection to the stamp pad (13) and the ink reservoir (15) is arranged with the stamp pad (13) in a bottom part (11.1) of the housing. The ink reservoir (15) comprises a reservoir region for accommodating an ink and a zone for accommodating the stamp pad (13), which comprises a plurality of outlet holes. In addition, the ink reservoir (15) comprises a plurality of capillary channels, which extend between the reservoir region and the zone, wherein each capillary channel leads to one of the outlet holes, to provide the fluid connection between ink reservoir (15) and the stamp pad (13).

18 Claims, 5 Drawing Sheets

MARKING DEVICE FOR MARKING BALLS, USE OF SUCH A MARKING DEVICE, AND METHOD FOR PROVIDING SUCH A MARKING DEVICE

The present invention relates to marking devices having a housing, a stamp pad, and an ink reservoir, wherein the ink reservoir has a fluid connection to the stamp pad.

The priority of European Patent Application EP 11166084.1 is claimed, which was filed on 13 May 2011 with the European Patent Office.

Tennis players typically mark their tennis balls to avoid confusion with the balls of other players. The markings are frequently applied using felt tip pens. It has been shown that the marking is often not permanent, or that the marking may only be differentiated with difficulty from the markings on balls of other players.

Markings are also applied in the case of other balls. This is performed to avoid confusion of the balls, on the one hand, and to mark balls which are only to be used in a hall, for example, on the other hand.

Heretofore, there has been no satisfactory solution which permits simple and permanent marking of balls by the user or player. A first good solution is known from the international patent application having the publication number WO09087011 A2. This document is used as the closest prior art.

The problem of the invention is to provide a solution, which allows simple and permanent marking of balls by the user or player. In particular, it relates to applying improvements to the previously known marking device, to make it more reliable, on the one hand, to improve the stamped image or printed image, and to improve the leak-tightness of the ink reservoir.

According to the invention, a marking device is provided, the features of which are to be inferred from Patent Claim 1. The use of a marking device can be inferred from Claim 12, and Claim 13 relates to a method for providing a marking device.

In all embodiments, an ink reservoir is preferably used as an ink cartridge and as a fluid intermediary or fluid bridge to a stamp pad. The ink reservoir is especially designed for the purpose of storing ink and only discharging it in small but consistent quantities by capillary action through capillary channels to the stamp pad.

Preferably, in all embodiments, at least a part of the capillary channels have an inlet opening in an associated material projection, wherein the material projection extends in the reservoir region almost up to a reservoir base.

In addition, the capillary channels at least partially have an inlet opening in the associated lower material projection. Thus, inter alia, also small residual quantities in the reservoir region are drawn through the inlet openings of the capillary channels into the capillary channels and reach the stamp pad via the fluid connection. In addition, at least a part of the reservoir region preferably encloses the material projections, in the interiors of which the capillary channels are seated. The holding capacity of the reservoir region is thus enlarged.

The capillary channels preferably have a uniform distribution over the entire surface of the stamp pad in all embodiments.

According to the invention, an even balance is sought, which is achieved in a geometric manner, by using the largest possible ink volume of a reservoir, on the one hand, and utilizing the dynamic response of the capillary action, on the other hand. These two concepts function differently depending on the spatial orientation and can accordingly be combined to form a suitable assembly.

The invention is distinguished by a modularity of the assembly and by the optional integration of the assembly in a suitable housing. The assembly can also be delivered and/or used without housing, however.

Balls, bodies, and other objects may be marked easily, rapidly, and permanently by way of the described and claimed approach.

However, the described and claimed approach may also be applied in other fields, in which a high-quality stamped image or printed image is in demand. Inter alia, the invention may be applied to identify natural products (for example, eggs) using a date stamp or origin stamp. However, the invention can also be used in the office, or in the case of reentry monitoring in institutions, for example.

The invention offers advantages in particular in the case of the application of a stamped image or printed image to a curved surface. However, the invention may also be used to apply a stamped image or printed image to a flat surface, wherein neither the stamp nor the housing must have a curved or arced shape in this case.

The invention also reaches the goal of achieving a high-quality stamped image or printed image, and allowing a correct and permanently uniform dosing of the ink, to improve the reproducibility of the stamped image or printed image.

In some of the embodiments, by replacing an ink reservoir assembly and/or an optional template, different markings can be applied.

Ink reservoir assemblies which are refillable are also implementable using the invention.

In other embodiments, by replacing a template, different markings can be applied.

In all embodiments, the quality of the markings is uniform and visually appealing.

In all embodiments, with more than one capillary channel can be provided per outlet hole.

Further details and advantages of the invention will be described hereafter on the basis of exemplary embodiments and with reference to the drawing.

DETAILED DESCRIPTION

Figure 1:
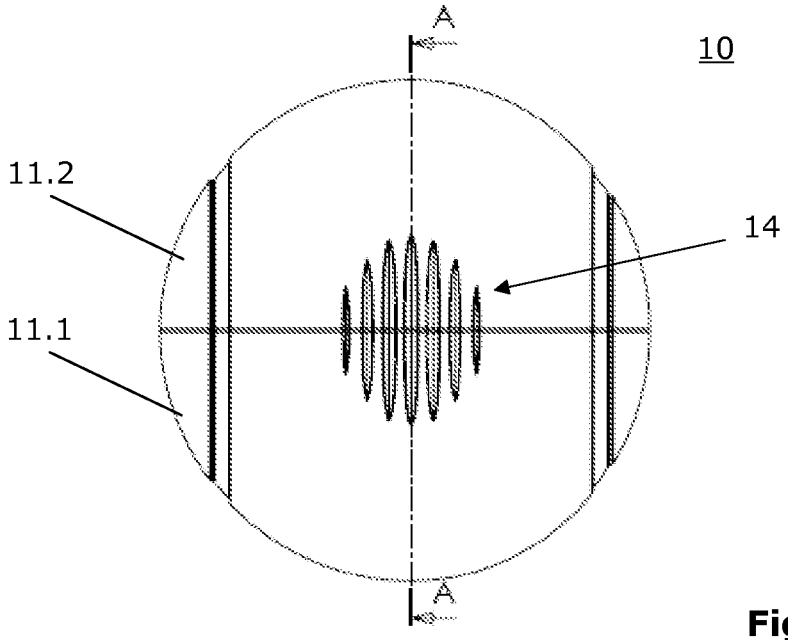
FIG. 1 shows a first embodiment of the invention in a side view in the closed state.

A preferred embodiment of the invention is described hereafter, which is especially designed for marking tennis balls 20. The invention can also be used, however, for marking other balls (soccer balls, hand balls or volleyballs, golf balls, etc.), bodies, or objects. The dimensions of the marking device 10 are preferably selected accordingly in this case.

The marking device 10 according to the invention preferably has a two-part housing having a bottom part 11.1 and a top part 11.2. In the simplest embodiment, the marking device 10 can only has a bottom part 11.1, which accommodates a so-called ink reservoir assembly 30.

In all embodiments, the ink reservoir assembly 30, which comprises a type of stamp pad 13 and an ink reservoir 15, is located in the bottom part 11.1. The stamp pad 13 and the ink reservoir 15 are arranged in the bottom part 11.1 of the housing in the sequence shown in FIG. 3. The ink reservoir 15 has a fluid connection to the stamp pad 13, so that a sufficient amount of ink liquid, which is stored in the bottom reservoir region 15.5 of the ink reservoir 15, moves in the direction of the stamp pad 13.

Figure 4A:
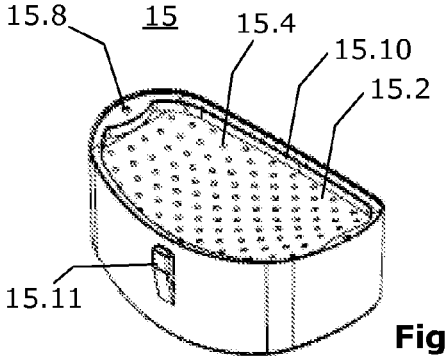
FIG. 4A shows a perspective top view of an ink reservoir according to the invention.
Figure 4B:
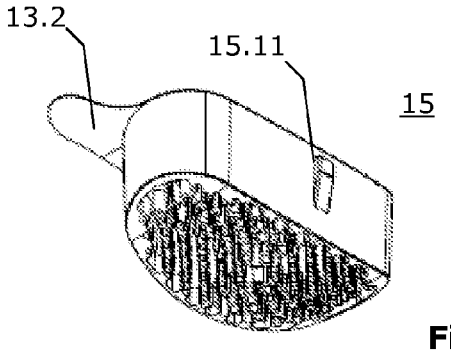
FIG. 4B shows a perspective bottom view of the ink reservoir according to FIG. 4A.
Figure 4C:
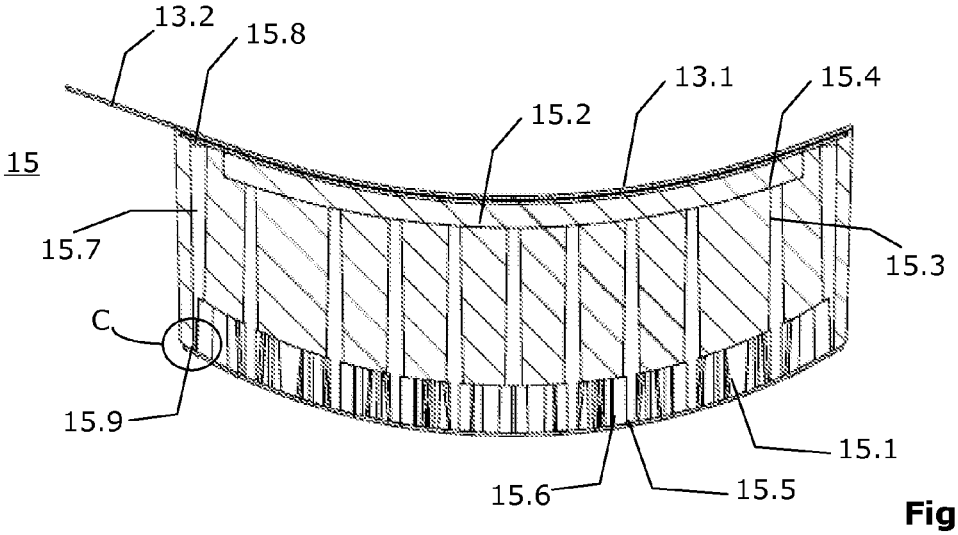
FIG. 4C shows a sectional view of the ink reservoir according to FIG. 4A.

It can be recognized more precisely on the basis of FIGS. 4A to 4C how the ink reservoir 15 is constructed in a preferred embodiment. The ink reservoir 15 comprises the mentioned bottom reservoir region 15.1 for accommodating the ink. In addition, it has a zone 15.2 in the top region, which is designed to accommodate the stamp pad 13. This zone 15.2 comprises a plurality of outlet holes 15.4, as can be seen in FIG. 4A. The zone 15.2 can be flat, curved, or completely rounded. The zone 15.2 preferably has a three-dimensional, curved shape in all embodiments, which corresponds to the shape of the stamp pad 13, as shown in FIGS. 4A-4C, for example.

A plurality of capillary channels 15.3 are provided, which extend between an external, laterally seated, or bottom reservoir region 15.1 and the zone 15.2. FIGS. 4A-4C show a preferred embodiment having bottom reservoir region 15.1. The capillary channels 15.3 can be seen in the sectional illustration in FIG. 2 and FIG. 4C. Each capillary channel 15.3 leads to one of the outlet holes 15.4, to provide the fluid connection between the ink reservoir 15 and the stamp pad 13.

According to the invention, embodiments are also possible in which the capillary channels 15.3 are also used as a reservoir for ink. In this case, the total holding capacity (ink volume) results from the volume of the actual reservoir region 15.1 and a partial volume of the capillary channels 15.3.

According to the invention, embodiments are also possible in which the reservoir region 15.1 is arranged laterally on the ink reservoir 15, or in which the reservoir region 15.1 encloses the ink reservoir 15.

Figure 6A:
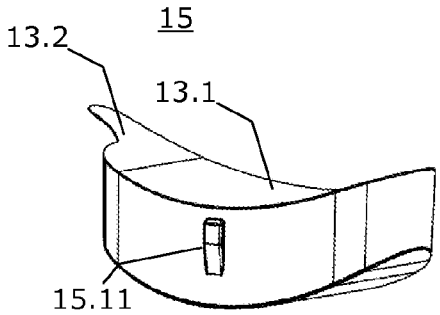
FIG. 6A shows a perspective top view of a further ink reservoir according to the invention.
Figure 6B:
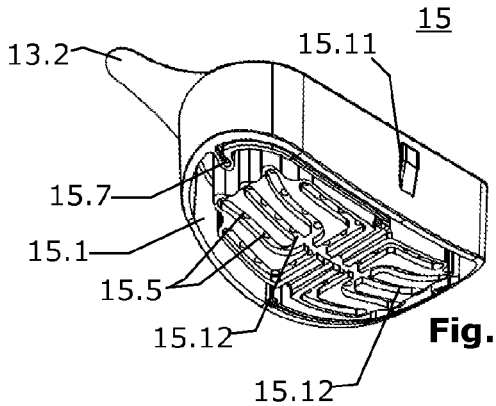
FIG. 6B shows a perspective bottom view of the ink reservoir according to FIG. 6A.
Figure 6C:
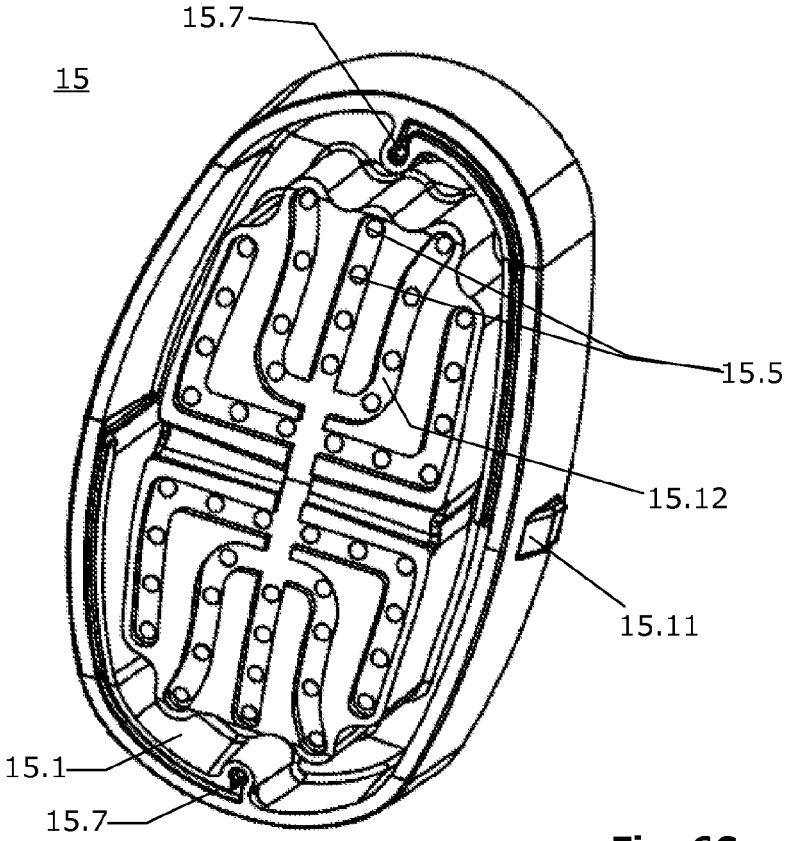
FIG. 6C shows a further perspective bottom view of the ink reservoir according to FIG. 6A.

FIGS. 6A-6C show a further embodiment, which has a plurality of advantages. Inter alia, this embodiment of the reservoir 15 has a greater holding capacity for ink, since reservoir region 15.1 not only extends below the capillary channel 15.3, but rather also encloses the reservoir 15 in the external region. The bottom side of the reservoir 15, which can be seen well in FIG. 6B, has a plurality of channels or regions 15.12, to be able to supply ink selectively and on demand to the individual capillary channels 15.3. By way of a special three-dimensional shaping and design of the channels or regions 15.12, as can be seen in FIG. 6B, for example, it is ensured that a sufficient quantity of ink is always available at each of the capillary channels 15.3. Even if the reservoir 15 is held inclined, a sufficient amount of ink is always available at the capillary channels 15.3. In addition, it is ensured that an excessive amount of ink is not available, which could cause the ink to leak out in unfavorable situations.

In other words, the reservoir 15 can have channels or regions 15.12 around the bottom region, which ensure a controlled supply of ink. This principle may be applied to all embodiments.

According to the invention, an even balance is sought, which is achieved in a geometric manner, by ensuring the largest possible ink volume of the reservoir 15, on the one hand, and by utilizing the dynamic response of the capillary action, on the other hand. These two concepts function differently depending on the orientation and can accordingly be combined to form a suitable assembly 30

The channels or regions 15.12 preferably extend in the form of fingers, wherein each of the channels or regions 15.12 supplies two or more than two capillary channels 15.3 with ink. The capillary channels 15.3 are thus supplied with ink in groups by the channels or regions 15.12. This principle may be applied to all embodiments.

The cross-sections of the channels or regions 15.12 are preferably selected such that inks are dosed by way of the flow rate. This principle may be applied to all embodiments.

Each capillary channel 15.3 preferably has a cross-section tapering in the direction of the zone 15.2 in all embodiments, i.e., the capillary channels 15.3 are preferably wider at the bottom than at the top.

Embodiments are particularly preferred, which are distinguished in that each capillary channel 15.3 has a maximum diameter, which is less than 3 mm. The maximum diameter is preferably less than 1.5 mm. The minimum diameter of the capillary channels 15.3 is preferably between 0.3 mm and 1 mm. The length of the capillary channels 15.3 is between 0.5 mm and 20 mm, preferably between 8 mm and 15 mm. These dimensions are particularly advantageous, since they allow a transport of the ink from the reservoir region 15.1 into the zone 15.2 based on capillary action, to thus ensure a uniform and appealing stamped image or printed image.

The preceding paragraph refers to a maximum diameter. It is obvious that the capillary channels 15.3 do not necessarily have to have a round cross-section. If a non-round cross-section is used, the maximum cross-sectional area QF is established as follows: $QF=\pi r^2$. The corresponding area specifications can thus be calculated from the above-mentioned millimeter specifications.

FIGS. 1 to 5 show a particularly preferred embodiment of the marking device 10, in which the ink reservoir 15 has a curved shape, which forms a concave shape on the side of the zone 15.2. The curved shape can be seen in FIGS. 2, 3, 4A, 4B, and 4C. The curved three-dimensional shape allows stamping or printing on three-dimensional objects, for example, a ball 20. The printed or stamped image can partially enclose the ball 20 along the circumference. The curved shape is preferably adapted to the jacket shape of the ball 20 in all embodiments. Therefore, for example, longer geometric shapes or a plurality of alphanumeric characters can be applied in succession to a ball 20 in one stamping procedure or printing procedure.

Embodiments are particularly preferred in which the ink reservoir 15 has at least one filling channel 15.7 having a top filling opening 15.8 and a bottom outlet opening 15.9. The filling channel 15.7 allows filling (and later refilling) of the ink in the reservoir region 15.1.

In all embodiments, the filling channel 15.7 preferably tapers from the filling opening 15.8 in the direction of the outlet opening 15.9. It is to be noted that in this case the shape of the filling channel 15.7 runs inversely to the shape of the capillary channels 15.3. The capillary channels 15.3 taper toward the top and the filling channel 15.7 tapers toward the bottom. This special design has the advantage that ink moves by means of capillary action automatically, i.e., without external pump action or suction action, from the reservoir region 15.1 through the outlet holes 15.4 toward the stamp pad 13. In the case of movement of the marking device 10, however, no ink can exit upward unintentionally through the filling channel 15.7. This is caused by the shape of the filling channel 15.7, which tapers toward the bottom.

All embodiments preferably have two such filling channels 15.7.

In addition, in all embodiments, the outlet opening 15.9 of the filling channel 15.7 is preferably located above the liquid level in the reservoir region 15.1. In FIG. 4C, the region in which the filling channel 15.7 ends is identified by a circle having the designation C. This measure also prevents ink from escaping in the event of shaking or transport.

The filling channel(s) 15.7 can also have another design and/or can be arranged differently.

The filling channel(s) 15.7 can also be protected by a membrane skin, for example, which is pierced using a thin needle or cannula in the event of filling, to be able to (re-)fill ink in the reservoir 15. In this case, the mentioned membrane skin is implemented as sufficiently elastic that the small opening which results upon piercing closes automatically after the filling, to prevent undesired escape of the ink. Such a variant having membrane skin may also be applied to all embodiments.

Alternatively or additionally, the filling channel(s) 15.7 can be protected using a flap, similar to a valve. Such a variant having flap may be applied to all embodiments.

However, embodiments are also possible which manage completely without filling channel(s) 15.7. Such embodiments are then filled through one or more capillary channels 15.3.

Embodiments which are not designed for refilling do not require any of the refilling capabilities which were mentioned above, of course.

Figure 2:
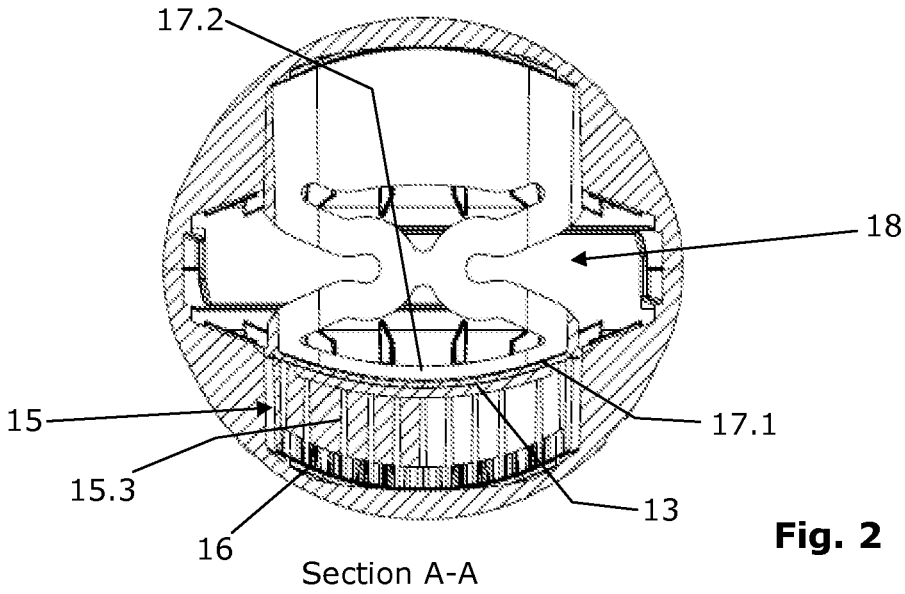
FIG. 2 shows a sectional view of the embodiment according to FIG. 1.
Figure 3:
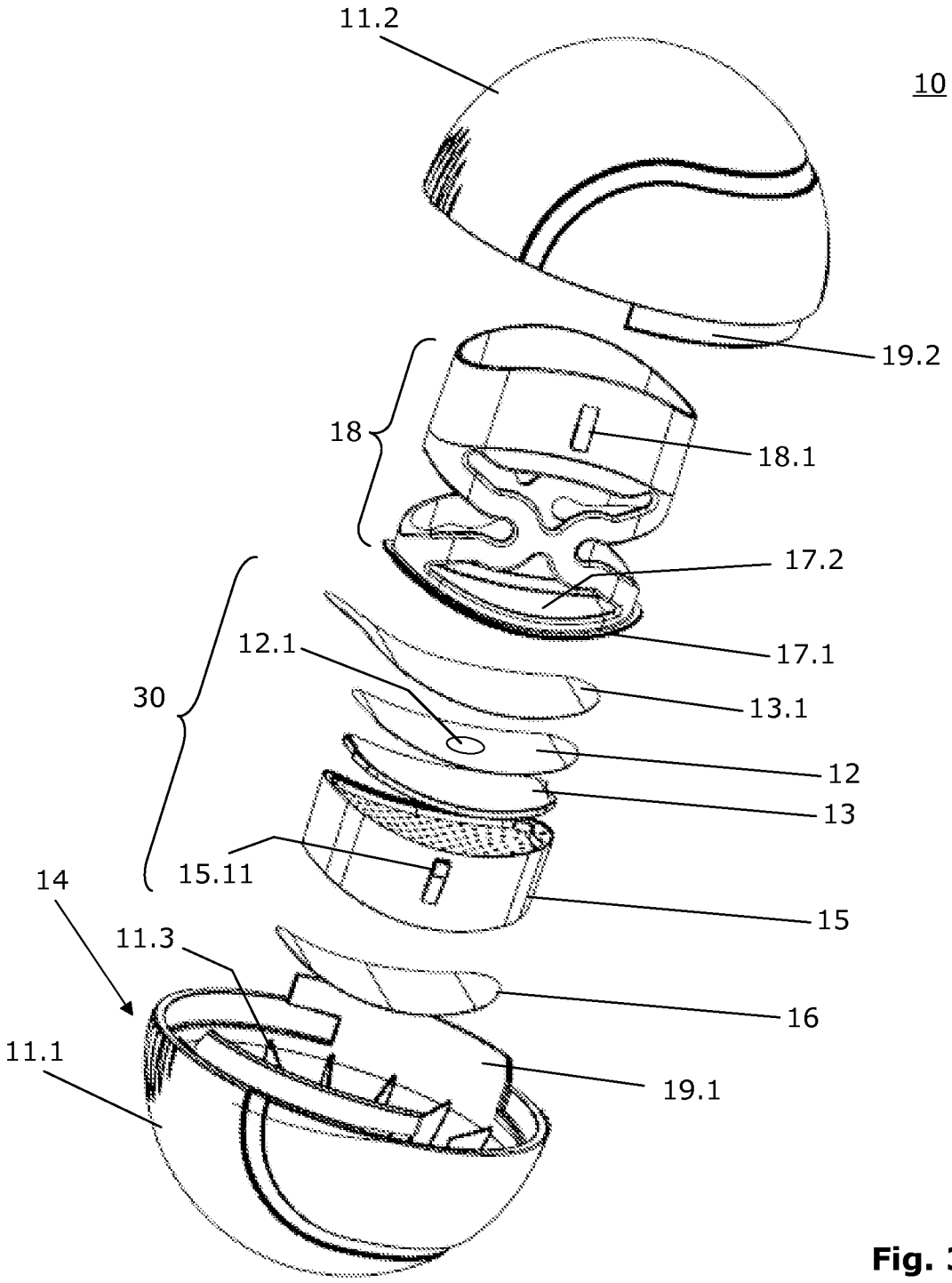
FIG. 3 shows an exploded view of the first embodiment of the invention.
Figure 5:
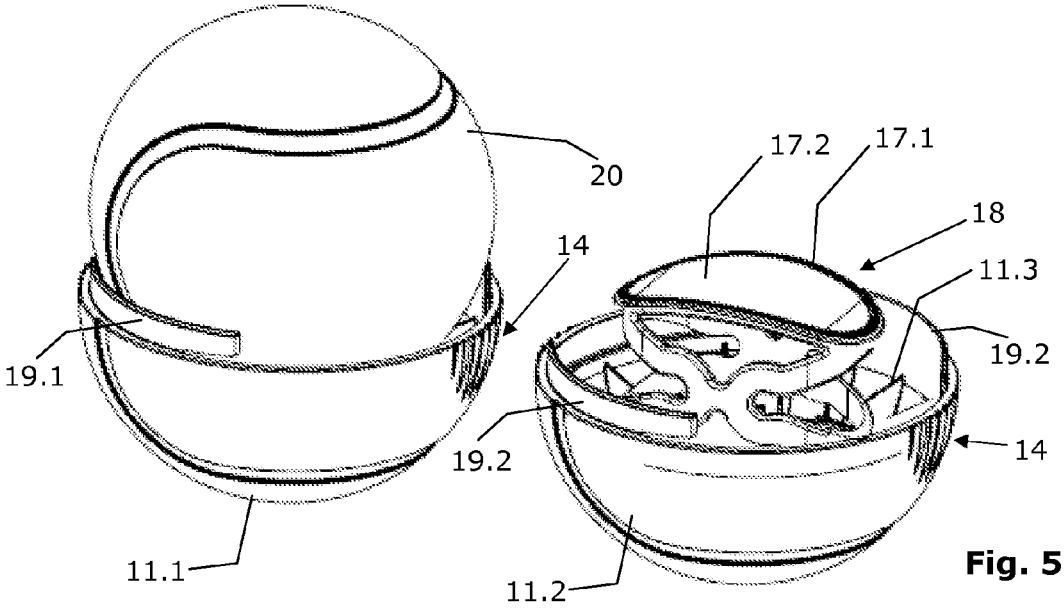
FIG. 5 shows a perspective view of the embodiment according to FIG. 1 in the open state while a tennis ball is pressed onto the bottom part of the marking device.

Embodiments are particularly preferred in which the ink reservoir 15 comprises, in the region of the zone 15.2, a circumferential collar 15.10, which is designed for placing or pressing on a sealing lip 17.1 of a contact pressure element 18. The circumferential collar 15.10 can be seen in FIG. 4A. An exemplary contact pressure element 18 having sealing lip 17.1 is shown in FIGS. 2, 3, and 5. This contact pressure element 18 is optional.

Embodiments are also possible in which a type of sealing lip is arranged on the reservoir 15, preferably in the region of the zone 15.2 for accommodating the stamp pad. However, sealing lips can also be provided on the reservoir 15 and on the contact pressure element 18. It is also possible to achieve the leak tightness only by interaction of the contact pressure element 18 with the zone 15.2 for accommodating the stamp pad.

Embodiments are also possible in which a part of the housing, for example, a circumferential wall, which encloses the reservoir 15, interacts with a contact pressure element 18, to thus ensure the required leak tightness.

Embodiments are also possible which comprise a separate lid, which must be manually removed to expose the stamp pad.

Embodiments having a top part 11.2 and such a contact pressure element 18 are preferred, since they press the stamp pad 13 and ink reservoir 15 into the bottom part 11.1 and, in the closed state of the marking device 10, they seal the stamp pad 13. In this state, in which the contact pressure element 18 has a pressure plate 17.2, which is preferably shaped to be complementary to the shape of the stamp pad 13 and is provided with a sealing lip 17.1, and is pressed against the top side of the ink reservoir 15 including stamp pad 13, the marking device 10 can be stored and transported without problems. No ink can escape in this state.

Preferably, the top part 11.2 and the bottom part 11.1 have bayonet coupling elements 19.1, 19.2 in all embodiments, wherein top part 11.2 and bottom part 11.1 can be connected to one another or disconnected from one another by a rotational movement. Corresponding details can be seen in FIGS. 3 and 5. A bayonet coupling is not obligatory.

The top part 11.2 and the bottom part 11.1 are preferably embodied as hemispheres in all embodiments. The top part 11.2 and the bottom part 11.1 can also have the shape of half-shells and other shapes, which may preferably be joined together to form a complete housing. Since the variety of shapes is large, instead of the terms top part 11.2 and bottom part 11.1, the terms first housing part 11.1 and second housing part 11.2 are also used here.

Figure 7A:
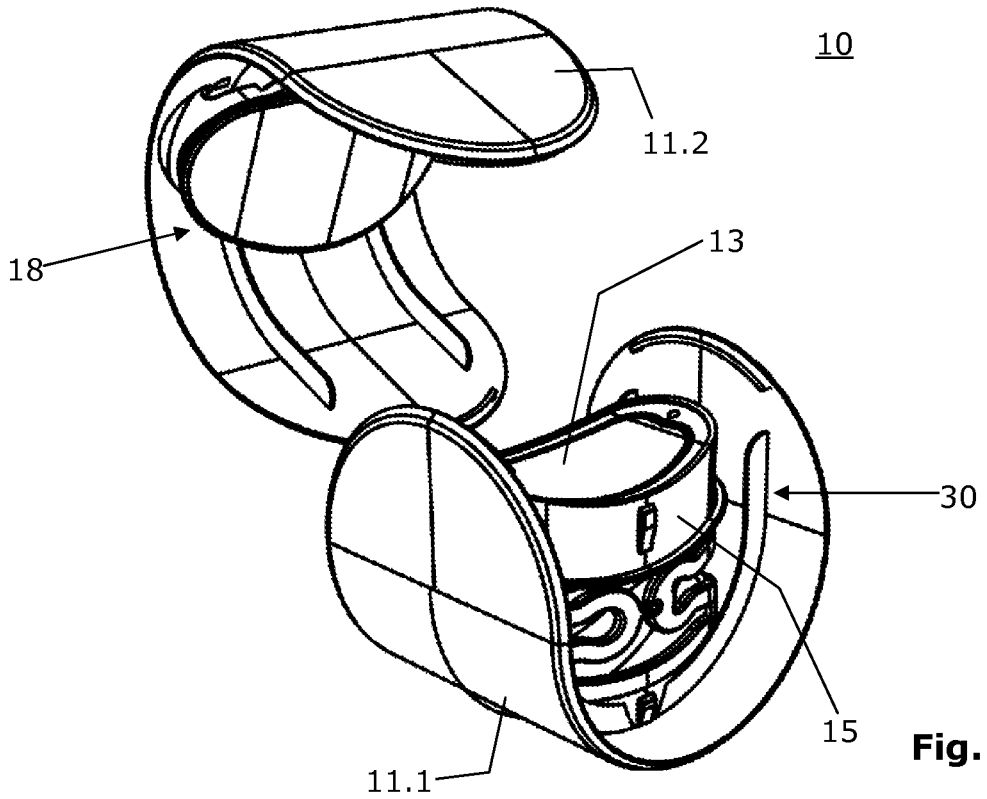
FIG. 7A shows a perspective view of a further embodiment in the open state.
Figure 7B:
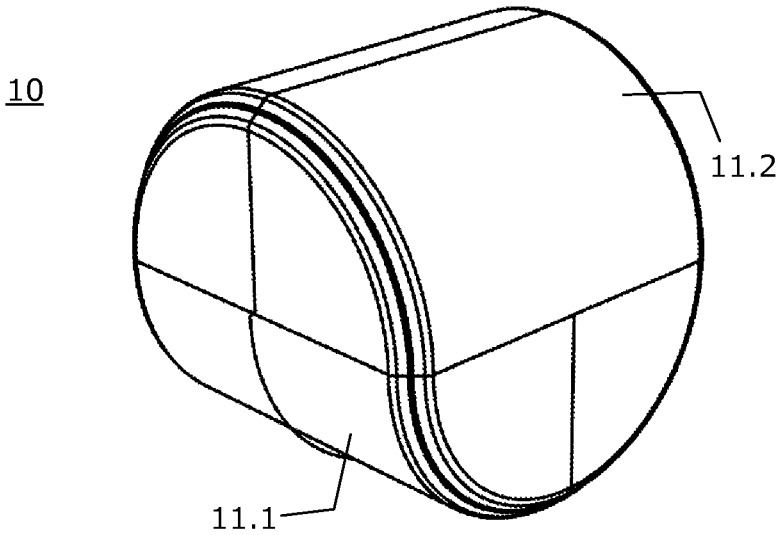
FIG. 7B shows a perspective view of the further embodiment according to FIG. 7A in the closed state.

An example of an embodiment in which the first housing part 11.1 and the second housing part 11.2 have the shape of interlocking half-shells is shown in FIGS. 7A and 7B.

The first housing part 11.1 and the second housing part 11.2 are preferably manufactured from injection-molded material and embodied identically in all embodiments. I.e., the two housing parts 11.1, 11.2 can be injection molded using the same injection mold.

By way of the special construction of the ink reservoir 15 having lateral, enclosing, or bottom reservoir region 15.1 and having capillary channels 15.3, ink can always flow or be suctioned into the stamp pad. The arrangement and embodiment of these elements was especially developed to prevent the ink reservoir 15 from leaking even in the event of inverted storage or handling.

The stamp pad 13 can be delimited on top by a replaceable template 12, which is arranged in the bottom part 11.1 of the housing or on the ink reservoir assembly 30 such that a part of the stamp pad 13 is accessible through an opening 12.1 (circular here, for example) of the template 12. For example, if a ball 20 is pressed against the stamp pad 13 including template 12, the ink is then transferred in the region of the opening 12.1 onto the ball 20. In the example shown, a fully colored circle would be stamped on the ball 20. The mentioned template 12 is optional.

It is also possible to design the stamp pad 13 such that it directly predefines the shape to be stamped. A negative or positive stamping method can be used here. In the case of a positive stamping method, the stamp pad has a circular section which is raised, for example. In this example, a fully colored circle would be stamped on the ball 20. In the case of a negative stamping method, the stamp pad has a circular section which is recessed, for example. In this example, a larger total area on the ball 20 would be stamped, which encloses a colorless circle. However, other symbols (geometric shapes, alphanumeric characters, and the like) can also be used.

The optional template 12 can be fastened manually or by machine in the bottom part 11.1 of the housing depending on the embodiment. The template 12 is preferably supplied at the factory as a fixed component of the marking device 10 or the ink reservoir assembly 30. However, other embodiments without template 12 are also possible, as described.

According to the invention, different assemblies can be prepared as needed, which are adapted to the respective conditions. In this way, for example, ink reservoir assembly 30 can be optimized to the customer wishes. One such assembly, which is preferably supplied as an ink reservoir assembly 30, comprises at least one reservoir 15 according to one of the described embodiments shown in the figures, one reservoir base 16 for sealing/closing the reservoir 15, wherein the reservoir base 16 can be a fixed component of the reservoir 15 or a separate element.

Preferably, such an assembly, which is preferably supplied as an ink reservoir assembly 30, additionally comprises a stamp pad 13, which can be structured or unstructured (i.e., over the entire area). A template 12 can optionally also be supplied with an unstructured stamp pad 13. The stamp pad 13 and/or the template 12 can be a permanent component of the reservoir 15, or they can be embodied as separate elements.

A customer-specific adaptation can result in changes at various points. The following elements can be adapted, but do not have to be:

shape and design of the reservoir 15;

shape and number of the capillary channels 15.3;

shape and design of the base region of the reservoir 15 (for example, with or without channels or regions 15.12);

shape and design of the stamp pad 13;

shape and design of the template 12, if provided.

The housing preferably comprises, as described, a second housing part 11.2, which can be manually disconnected from the first housing part 11.1, to expose an access to the stamp pad 13. After the second housing part 11.2 has been removed, the first housing part 11.1 of the marking device 10 having the stamp pad 13 can be pressed against a ball 20, or a ball 20 can be pressed against the stamp pad 13. This state is shown on the left in FIG. 5.

The marking device 10 can also be used for other stamping or marking purposes.

The dimensions of the housing having the housing parts 11.1 and 11.2, and also the size and placement of the stamp pad 13 are selected such that the ball 20 or another object penetrates with its jacket or its envelope a small amount into the housing part 11.1, to thus come into contact with the stamp pad 13 and the ink which is in the stamp pad 13.

The bottom part 11.1 of the housing and the top part 11.2 of the housing preferably each have the shape of a hollow hemisphere, as already mentioned. Therefore, the housing is similar to a tennis ball 20, above all when it is assembled, as shown in FIG. 1.

The housing parts 11.1 and 11.2 preferably have bayonet coupling elements 19.1, 19.2, as mentioned above and as can be seen in FIGS. 1 to 3. The second housing part 11.2 and the first housing part 11.1 can then be connected to one another or disconnected from one another by a manual rotational movement. The bayonet connection by means of bayonet coupling elements 19.1, 19.2 has the advantage that the two parts 11.1, 11.2 of the housing can be securely and easily fastened to one another. Leaking out of the ink or soiling of bags in which the marking device 10 is stored can thus be prevented.

All of the mentioned measures, which have been described up to this point, preferably cooperate to prevent the ink from leaking out.

Waterproof ink is preferably used for marking or printing balls 20. The ink reservoir 15 is therefore especially designed for accommodating waterproof ink.

The diameter of a tennis ball is between 6.35 cm and 6.67 cm. The stamp 10 is distinguished in that each of the hemispheres or housing parts 11.1, 11.2 has a diameter which is greater than 6 cm and less than 10 cm. These dimension specifications apply at least for embodiments which are designed for identifying tennis balls 20.

In general, the diameter of the stamp housing made of first housing part 11.1 and second housing part 11.2 is preferably approximately 10% to 20% larger than the diameter of the ball 20 to be marked. This specification applies for small balls 20. In the case of soccer balls and other large balls, the marking device can be significantly smaller than the ball itself.

In all embodiments, the marking device can comprise one housing part, two housing parts, and also more than two housing parts.

In addition to exchanging/replacing the template 12 and/or the entire ink reservoir assembly 30, the stamp color can also be changed on demand. Numerous combination possibilities are thus provided. Entire assemblies can also be offered as desired, as described above.

In a further embodiment of the invention, the two tennis ball stamp halves (i.e., the first housing part 11.1 and the second housing part 11.2) of the marking device 10 are constructed identically. In this case, both parts 11.1, 11.2 contain at least one ink reservoir assembly 30. Therefore, two stamping capabilities (one per "housing part" 11.1, 11.2) are thus available per marking device 10.

The housing parts 11.1 and 11.2 can be freely replaceable and can therefore be joined together arbitrarily thanks to optional bayonet coupling 19.1, 19.2.

The first housing part 11.1 and the second housing part 11.2 and/or the other elements 12, 15, 18 are preferably manufactured from injection-molded plastic.

All embodiments preferably have handle grooves or handle regions 14, to be able to grasp the marking device 10 better, or to be able to twist the first housing part 11.1 and the second housing part 11.2 better in relation to one another. Corresponding handle regions 14 can be seen in FIGS. 1, 3, and 5.

All embodiments preferably have means which transmit a deformation of the housing or one of the housing parts 11.1, 11.2 to the assembly 30. In this way, by applying a force to the housing, the assembly 30 can be detached from the housing, as explained hereafter.

Preferably, all embodiments have a pressure point or pressure region on the bottom part 11.1, to be able to latch or unlatch the ink reservoir 15, or the ink reservoir assembly 30, into or out of the bottom part 11.1. For the latching, the ink reservoir 15 is preferably provided with lateral lugs 15.11, as shown in FIGS. 3, 4A and 4B, 6A, 6B, and 6C. In this case, corresponding depressions or receptacle holes are provided in the interior of the housing part 11.1. The mentioned handle regions 14 are preferably used as a pressure point or pressure region.

Preferably, all embodiments have internal radial webs 11.3 (see FIG. 3, for example) on the housing part 11.1 and on the housing part 11.2, to be able to fix the ink reservoir assembly 30 and/or the contact pressure element 18 in the respective housing part 11.1 or 11.2.

Preferably, all embodiments have a contact pressure element 18 in the housing part 11.2. This contact pressure element 18 is preferably embodied as springy, to exert a pressure on the stamp pad 13 and/or the circumferential collar 15.10 of the ink reservoir assembly 30 when connecting the housing part 11.1 to the housing part 11.2. The bayonet coupling elements 19.1, 19.2 can be designed as slightly inclined, to cause a feed movement of the contact pressure element 18 in the direction of the stamp pad 13 and/or the circumferential collar 15.10 when connecting the parts to one another.

Preferably, the contact pressure element 18 can also be provided in all embodiments with lateral lugs 18.1 (see FIG. 3). In this case, corresponding depressions or receptacle holes are provided in the interior of the top part 11.2.

The springy action of the contact pressure element 18 is preferably implemented in all embodiments by a correspondingly shaped injection-molded element.

All embodiments preferably have a film or a lid 13.1, which protects and/or seals the stamp pad 13. A corresponding film or a corresponding lid 13.1 is shown in FIGS. 3, 4B and 4C, 6A. The film or the lid 13.1 can comprise a handle 13.2, which allows opening or pulling off. The ink reservoir assembly 30 is preferably sealed per se in all embodiments, as long as the film or the lid 13.1 is present.

The ink reservoir 15 is preferably used in all embodiments as an ink cartridge and as a fluid intermediary or fluid bridge to the stamp pad 13. The ink reservoir 15 is especially designed for the purpose of storing ink and only discharging it in small but consistent quantities by capillary action through the capillary channels 15.3 to the stamp pad 13.

The capillary channels 15.3 preferably have a uniform distribution over the entire surface of the stamp pad in all embodiments.

The ink reservoir 15 is preferably produced in one piece from injection-molded material in all embodiments. However, the ink reservoir 15 can also be injection molded from two parts (on the height and on the length).

The ink reservoir 15 is preferably delimited and sealed in all embodiments on the base side by the reservoir base 16. This reservoir base 16 is preferably glued, welded, or vulcanized onto the ink reservoir 15 after the injection molding of the ink reservoir 15. FIGS. 4A to 4C show the ink reservoir 15 without reservoir base 16. The reservoir base 16 can be seen in FIGS. 2 and 3.

The capillary channels 15.3 preferably at least partially have an inlet opening 15.5 in an associated bottom material projection 15.6 in all embodiments. This material projection 15.6 extends in the reservoir region 15.1 up close to a reservoir base 16. The material projections 15.6 are embodied like stalactites, which hang from the top down into the reservoir region 15.1 and do not touch the reservoir base 16. Preferred embodiments therefore have a jagged bottom side on the ink reservoir 15, as can be seen in FIG. 4B. Each capillary channel 15.3 preferably begins in a separate material projection 15.6, i.e., one capillary channel 15 extends upward per material projection 15.6.

LIST OF REFERENCE SIGNS marking device 10
bottom part 11.1
top part 11.2
radial webs 11.3
optional template 12
template opening 12.1
stamp pad 13
film or lid 13.1
handle 13.2
handle groove or handle region 14
ink reservoir 15
reservoir region 15.1
zone to accommodate the stamp pad 15.2
capillary channels 15.3
outlet holes 15.4
inlet opening 15.5
material projection 15.6
filling channel 15.7
filling opening 15.8
outlet opening 15.9
collar 15.10
lug(s) 15.11
channels or regions 15.12
reservoir base 16
sealing lip 17.1
pressure plate 17.2
contact pressure element 18
lugs 18.1
bayonet coupling elements 19.1, 19.2
tennis ball 20
ink reservoir assembly 30
cross-sectional area QF
region C

The invention claimed is:

1. A marking device (10) having
a stamp pad (13) and
an ink reservoir (15),
wherein the ink reservoir (15) has a fluid connection to the stamp pad (13), and wherein the ink reservoir (15) comprises:
a reservoir region (15.1) for accommodating an ink, the reservoir region has a thickness,
a zone (15.2) for accommodating the stamp pad (13), which comprises a plurality of outlet holes (15.4),
a plurality of capillary channels (15.3), which extend between the reservoir region (15.1) and the zone (15.2), wherein each outlet hole (15.4) can be supplied by at least one capillary channel (15.3), to provide the fluid connection between ink reservoir (15) and the stamp pad (13),
characterized in that
at least a part of the capillary channels (15.3) have an inlet opening (15.5) in an associated material projection (15.6), wherein the material projection (15.6) extends in the reservoir region (15.1) adjacent to a reservoir base (16), and
the capillary channels (15.3) at least partially have an inlet opening (15.5) in the associated bottom material projection (15.6).

2. The marking device (10) according to claim 1, characterized in that the material projections (15.6) are embodied like stalactites, which hang from above down into the reservoir region (15.1) and do not touch the reservoir base (16).

3. The marking device (10) according to claim 1, characterized in that the ink reservoir (15) is used as an ink cartridge and as a fluid intermediary or fluid bridge to the stamp pad (13).

4. The marking device (10) according to claim 3, characterized in that the ink reservoir (15) is produced in one piece from injection-molded material.

5. The marking device (10) according to claim 1, characterized in that the ink reservoir (15) is delimited and sealed on the base side by the reservoir base (16).

6. The marking device (10) according to claim 1, characterized in that two or more of the capillary channels (15.3) can be supplied with ink from the reservoir region (15.1) in groups by channels or regions (15.12).

7. The marking device (10) according to claim 1, characterized in that each capillary channel (15.3) has a cross-section tapering in the direction of the zone (15.2).

8. The marking device (10) according to claim 1, characterized in that each capillary channel (15.3) has a maximum diameter which is less than 3 mm.

9. The marking device (10) according to claim 1, characterized in that the ink reservoir (15) has a curved shape, which forms a concave shape on the side of the zone (15.2).

10. The marking device (10) according to claim 1, characterized in that the ink reservoir (15) has at least one filling channel (15.7) having a filling opening (15.8) and an outlet opening (15.9), which allows filling of the ink in the reservoir region (15.1), wherein the filling channel (15.7) preferably tapers from the filling opening (15.8) in the direction of the outlet opening (15.9).

11. The marking device (10) according to claim 1, characterized in that the ink reservoir (15) comprises a circumferential collar (15.10) in the region of the zone (15.2), which is designed for placing or pressing on a contact pressure element (18).

12. The marking device (10) according to claim 1, characterized in that it comprises the housing having a first housing part (11.1) and a second housing part (11.2), wherein the first housing part (11.1) and the second housing part (11.2) preferably have the shape of a hollow half-mold, preferably a hemisphere.

13. The marking device (10) according to claim 12, characterized in that it has means which allow detachment of the stamp pad (13) and/or the ink reservoir (15) from a housing by applying a force to the housing.

14. The marking device (10) according to claim 12, characterized in that the second housing part (11.2) comprises an internal contact pressure element (18), which is designed such that when the second housing part 11.2) is connected to the first housing part (11.1), a contact pressure can be exerted on the ink reservoir (15), to seal the ink reservoir (15).

15. A method for providing a marking device (10) having a stamp pad (13) and an ink reservoir (15), wherein the ink reservoir (15) comprises:

a reservoir region (15.1) for accommodating an ink, the reservoir region has a thickness, a zone (15.2) for accommodating the stamp pad (13), which comprises a plurality of outlet holes (15.4), a plurality of capillary channels (15.3), which extend between the reservoir region (15.1) and the zone (15.2), wherein each outlet hole (15.4) is applied by at least one capillary channel (15.3), to provide the fluid connection between the ink reservoir (15) and the stamp pad (13), characterized by the following steps:

filling the reservoir region (15.1) with the ink, bringing the ink reservoir (15) into fluid connection with the stamp pad (13), wherein at least a part of the capillary channels (15.3) have an inlet opening (15.5) in an associated material projection (15.6), wherein the material projection (15.6) extends in the reservoir region (15.1) adjacent to a reservoir base (16), and wherein the capillary channels (15.3) at least partially have an inlet opening (15.5) in the associated material projection (15.6).

16. The method according to claim 15, characterized by the following step:

inserting the ink reservoir (15) into a housing (11.1, 11.2).

17. The method according to claim 15, characterized by the following step:

removing a lid (13.1), which protects and/or seals the stamp pad (13).

18. The method according to claim 15, characterized by the following step:

inserting a template (12).

* * * * *